United States Patent [19]

Pickens et al.

[11] 4,297,136

[45] Oct. 27, 1981

[54] HIGH STRENGTH ALUMINUM ALLOY AND PROCESS

[75] Inventors: Joseph R. Pickens, Ringwood, N.J.; Robert D. Schelleng, Suffern; Stephen J. Donachie, New Windsor, both of N.Y.; Thomas J. Nichol, Cheshire, Conn.

[73] Assignee: The International Nickel Co., Inc., New York, N.Y.

[21] Appl. No.: 951,590

[22] Filed: Oct. 16, 1978

[51] Int. Cl.[3] ..... B22F 3/14; B22F 3/00

[52] U.S. Cl. ..... 75/206; 75/200; 75/234; 75/235

[58] Field of Search ..... 75/200, 206, 234, 235

[56] References Cited

U.S. PATENT DOCUMENTS 3,607,254 9/1971 Hammond ..... 75/206

OTHER PUBLICATIONS

Bufferd et al., "SAP-Type Alloys Solid Solution Strengthened with Magnesium", Trans. Asm., vol. 60, pp. 305–309, 1967.

Gurney et al., "The Influence of Extrusion-Consolidation Variables on the Integrity and Strength of the Product from Prealloyed 7075 Aluminum Powder", Powder Met. 974, vol. 17, #33, 1974, pp. 46–49.

Park et al., "Properties of Extruded Aluminum-Iron P/M Materials", Int. J. Powder Met., vol. 14, #4, pp. 305–321, Oct. 1978.

Jangg et al., "Dispersion Hardening of Aluminum with $Al_4C_3$", Powder Met. International, vol. 9, #1, 1977, pp. 24–26.

*Primary Examiner*—Brooks H. Hunt

*Attorney, Agent, or Firm*—Raymond J. Kenny; Miriam W. Leff

[57] ABSTRACT

An improved process for hot working of dispersion-strengthened mechanically alloyed aluminum is provided based on a disclosed unconventional response of such material to thermomechanical processing. The process permits optimization of strength and workability and the production of aluminum alloys of very high strength.

22 Claims, 3 Drawing Figures

HIGH STRENGTH ALUMINUM ALLOY AND PROCESS

The present invention relates to powder metallurgy, and more particularly to a method for controlling and/or optimizing strength and workability of dispersion-strengthened aluminum and aluminum alloys by variations in thermomechanical processing of mechanically alloyed powders.

In recent years considerable research efforts have been expended to develop high strength aluminum which would satisfy the demands of advanced design in aircraft, automotive, and electrical industries. It is known to increase the strength of aluminum by the use of certain additives which will form, for example, dispersion-strenghened, age hardened and solid solution hardened alloys. The use of any particular additives or combinations of them depend on desired properties in addition to strength, such as corrosion resistance, ductility, electrical conductivity and hardness. It will be appreciated that the property requirements depend on ultimate use of the aluminum. The processing of aluminum alloys may be through the formation of ingot melts or various powder metallurgy techniques. Using either the ingot melt or powder metallurgy route the incorporation of additivies which strengthen aluminum usually decreases its workability. Workability takes into account ductility at the working temperature and the load necessary to form the material.

The forming of shaped high strength aluminum products from powders is known to have advantages over traditional ingot metallurgy processes. Oxide dispersion-strengthening is, in general, more easily accomplished by powder metallurgy techniques than be forming oxides in an ingot. A fine dispersion of insoluble alloying additives is made possible by powder metallurgy. A fine grain size can often be easily obtained by powder metallurgy by restricting powder particle size, and strengthening is easily accomplished by substructure strengthening which eliminates the need for costly working operations required after billet formation. Powder metallurgy generally produces more homogeneous material and offers more accurate and precise control over chemical composition than ingot melts. Also, difficult to handle alloying elements can at times be more easily introduced via powder metallurgy than by ingot melt techniques.

U.S. Pat. Nos. 3,740,210 and 3,816,080 (incorporated herein by reference) disclose a process for preparing and consolidating mechanically alloyed dispersion-strengthened aluminum. These patents further disclose a means for applying the concept of U.S. Pat. No. 3,591,362 (also incorporated herein by reference) to dispersion-strengthened aluminum. This dispersion-strengthened mechanically alloyed powder is different from the sintered aluminum product commonly referred to as S.A.P., which is produced by a complex process including flaking of the aluminum particles in the presence of a high amount of stearic acid to form an oxide surface on the flakes, and then removing the stearic acid before the particles are consolidated. For most uses, a powder must be fabricated into a final product, which is ultimately a metal forming operation, e.g. by hot pressing, hot die compacting, or cold isopressing followed by extrusion, forging or rolling. The mechanically alloyed powder, as opposed to S.A.P., tends to produce a material which requires a lower level of dispersoid to achieve the same level of strength with greater ductility. Thus, there is a greater potential for producing materials with greater strengh and/or higher workability with mechanically alloyed powders than with conventional aluminum powders such as S.A.P. Further, the use of the mechanical alloying technique enables the production of aluminum alloys of very high strength without resorting to age hardening additives. Age hardening in conventional aluminum alloys may produce internal composition differences at the grain boundaries, which are associated with high susceptibility to stress corrosion cracking. Also, age hardened alloys soften upon elevated temperature exposure as strengthening precipitates coarsen. Thus, mechanically alloyed aluminum, which can be strengthened sufficiently without the use of age hardening elements, has a potential for certain high corrosion resistance applications, e.g. aircraft skins without cladding, aircraft interior structural members, inexpensive watch casings, rifle parts, lightweight automotive parts, etc.

The method disclosed in the aforementioned U.S. Pat. Nos. 3,740,210 and 3,816,080 for producing mechanically alloyed powders also discloses examples of consolidated products produced under various conditions. In general, the materials were shown to be extruded at about 850° to 900° F. at extrusion ratios of 45:1 and 28:1, and they are shown to have room temperature UTS (ultimate tensile strength) of about 45 to 66 ksi. From these data it could be assumed that the properties would vary with changes in the thermomechanical treatments consistent with reported responses of aluminum alloys. For example, in a study of extrusion-consolidation processing variables on 7075 aluminum powder reported by F. J. Gurney et al in POWDER MET., 17 (33), pp. 46–69, the aluminum alloys are initially strengthened as the extrusion ratio increases, and then there is little effect on strength until higher ratios, e.g. about 6–10:1, are reached. The Gurney et al study also shows that increasing the extrusion temperature above about 600° F. causes an increase in strength. The general behavior in extruding aluminum alloys is also shown in S.A.P. For example, J. H. Swartzwelder (INT. J. POWDER MET. 3 (3) 1967) extruded 14 ;wt. % S.A.P. alloys at extrusion ratios varying from 2:1 to 79:1 and 8 wt. % dispersoid alloys at ratios of 2:1 to 76:1. Both S.A.P. alloys showed a rapid increase in tensile strength as extrusion ratios increased up to about 8:1. The more extensive data obtained for the 8 wt. % dispersoid alloy show a leveling out or slight increase in tensile strength after the initial rapid increase.

It has now been found, however, that contrary to the behavior expected, dispersion-strengthened mechanically alloyed aluminum has an unconventional response to thermomechanical processing. The knowledge of this unexpected behavior of the mechanically alloyed aluminum can be used to control properties when the material is hot worked into useful form, making it possible to process the material with optimization of the properties of workability and strength. Optimization may involve selection of processing conditions to obtain the highest possible strength or sacrificing strength for workability, depending on the requirements of the end product.

The unconventional response of mechanically alloyed dispersion-strengthened aluminum to thermomechanical processing is illustrated in the accompanying figures.

SUMMARY OF THE INVENTION

Generally speaking the present invention is directed to an improved method for producing hot worked dispersion-strengthened mechanically alloyed aluminum.

One aspect of the invention resides in the selection of a composition which has in compact form suitable strength so that it is potentially possible to obtain a product of a desired strength. Another aspect of the invention resides in controlling the thermomechanical processing conditions to achieve predictably a desired strength of the material relative to the workability required for a given application. The appropriate choice of composition and selection of processing conditions are made possible through the recognition of the anomolous response of dispersion-strengthened mechanically alloyed aluminum to hot working compared with prior art aluminum alloys. Thus, in accordance with the present invention a dispersion-strengthened mechanically alloyed aluminum is hot worked to form a product having a required strength by a method comprising:

(a) selecting as the initial charge material a dispersion-strengthened mechanically alloyed aluminum material having in compacted form prior to hot working a room temperature tensile strength at least equal to the room temperature tensile strength of the hot worked product, said charge material also having the property in a temperature range up to incipient melting of increased workability with increasing working temperature;

(b) determining the working temperature-strength profile of the selected material, said profile being characterized by an overall decrease in strength relative to the working temperature; and (c) hot working the charge material at a temperature selected with reference to said profile to optimize the workability of the charge material and the strength of the hot worked product.

Figure 1:
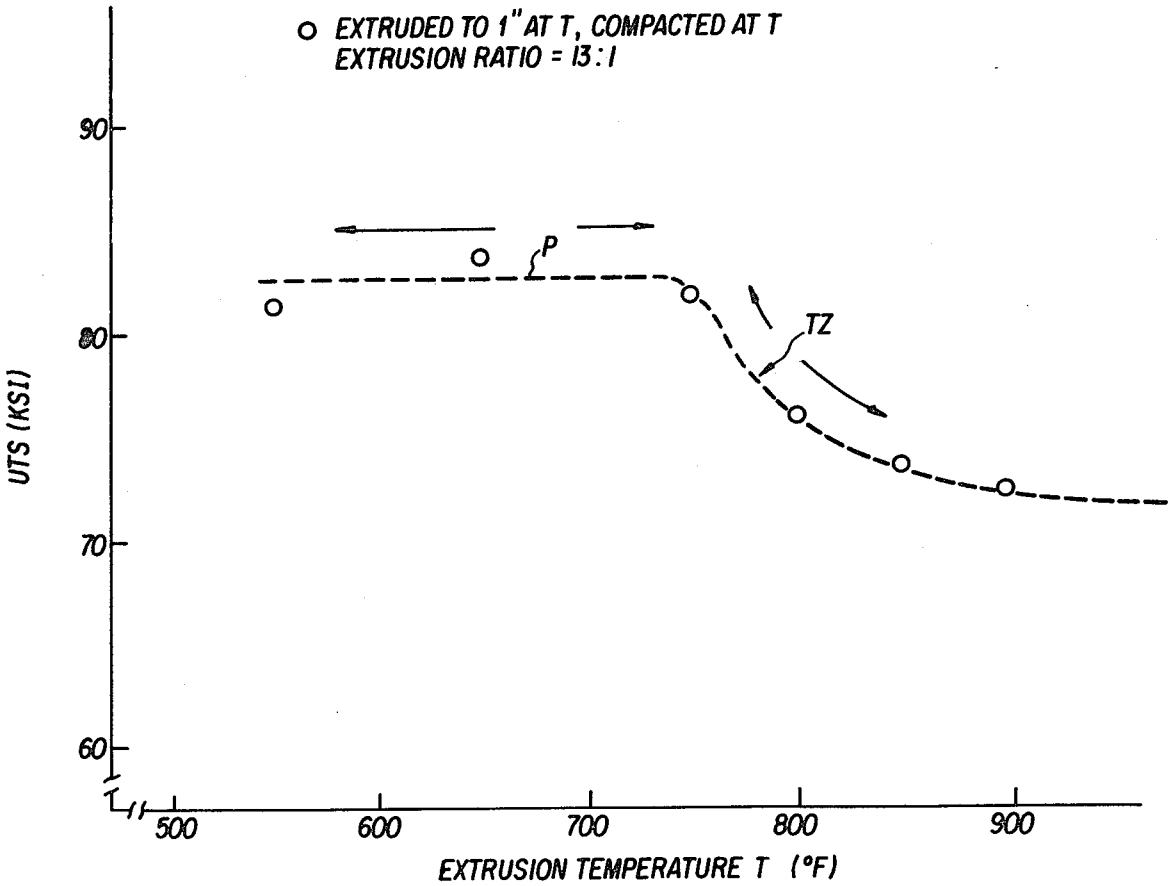
FIG. 1 is a graph showing a working temperature strength profile of a dispersion-strengthened mechanically alloyed aluminum of the present invention.

In accordance with another aspect of this invention the working temperature-strength profile includes a critical-working temperature-strength transition zone which is characterized by a sharp lowering of room temperature strength relative to increased working temperature, as illustrated in FIG. 1. For optimized workability of the charge material and strength of the hot worked product, the hot working temperature is selected with reference to this transition zone.

Figure 2:
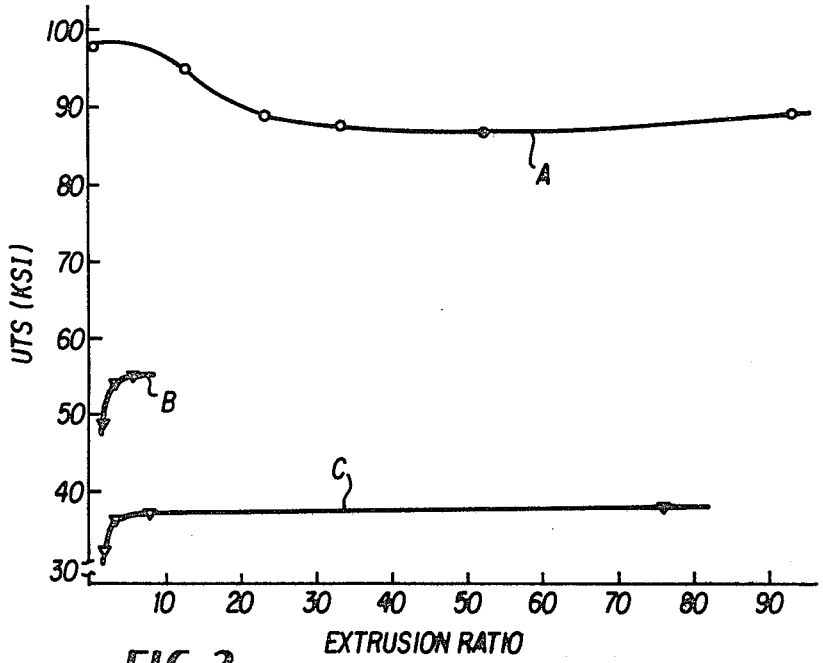
FIG. 2 is a graph showing the effect of extrusion ratio at an extrusion temperature of 650° F. (343° C.) on room temperature tensile strength (UTS) of an alloy of the present invention (Curve A) and a comparison with the effect on a prior art aluminum alloy, viz. S.A.P. (Curves B and C) containing substantially higher dispersoid levels than the alloy of Curve A.

In a preferred embodiment of the present invention, the working temperature-strength profile shows a pattern of behavior which includes a strength-temperature plateau, shown as "P" in FIG. 1, in which region an increase in working temperature has substantially no affect on strength. In the embodiment of FIG. 1, the maximum temperature of the plateau is between about 700° F. and about 750° F. Above the maximum there is a critical working temperature-strength transition zone, shown as "TZ" in FIG. 1. In accordance with this pattern, the use of working temperatures below those of the "TZ" zone permits processing of the alloys at temperatures for optimum workability without sacrifice of strength. Also in keeping with the pattern, if greater workability is required and lower strength permissible, the processing may be carried out at a higher temperature than that permitted for maximum strength. Alternatively, if because of workability considerations it is necessary to process a material at temperatures in or above the critical transition zone, compensating changes in prior processing can be applied to assure that the required strength can be achieved. FIG. 2, which shows the difference in the effect of extrusion ratio on strength of a material of the present invention (Curve A) from the effect on two samples of prior art aluminum alloys having different dispersoid levels, illustrates that for material of the present invention, unexpectedly, its initial compacted strength, i.e., before thermomechanical treatment, must be greater than the strength required for a particular product. In other words, in materials of the present invention, strength of the product will not increase with thermomechanical working in the range studied, as would be expected from the reported behavior of other aluminum alloys.

In accordance with a particular aspect of the present invention, a dispersion-strengthened mechanically alloyed aluminum consisting essentially, by weight, of up to about 7% magnesium, up to about 2½% carbon, up to about 4% oxygen, and the balance essentially aluminum and having a predetermined critical temperature-strength transition zone is hot worked to a consolidated product having a required strength, as indicated above. Preferably, for high corrosion resistance, the material will contain about 2% up to about 5% magnesium.

Bearing in mind that the processing conditions for the present materials shown in the accompanying figures are developed in particular equipment with a specific composition which has been processed to obtain a given initial strength, a dispersion-strengthened mechanically alloyed aluminum containing about 2% up to about 5% magnesium, up to about 2½%, carbon, up to about 4% oxygen can be extruded optimally for highest workability and highest room temperature strength in the product at temperature-strength profile equivalent to that shown in FIGS. 1 and 2. For example, for the composition and equipment used, for highest strength hot working is carried out at a temperature in the range of about 650° F. (340° C.) up to below about 750° F. (400° C.), the critical transition temperature zone being in the range of about 750° F. to about 800°–850° F. For greater workability, processing may be carried out at a higher temperature than in the maximum plateau temperatures, but there will be a sacrifice in strength.

In accordance with another aspect of the present invention the ultimate tensile strength of an extruded dispersion-strengthened mechanically alloyed aluminum consisting essentially of about 2 to about 7%Mg, up to about $2\frac{1}{2}$%C., up to about 4% oxygen and the balance essentially aluminum, and containing a small but effective amount for improved strength e.g. about 1 volume % up to about $8\frac{1}{2}$ volume % dispersoid can be optimized by employing processing conditions in the interrelationship set forth by the following formula:

$$UTS = -0.05919T_1 - 0.01434T_2 - 0.0343T_3 - 0.0554E_R + 11.55(\text{wt. \% O}) + 20.08(\text{wt. \% C}) - 0.18\epsilon - 2.975t + 214.6$$

where

UTS = Ultimate Tensile Strength (at room temperature)

$T_1$ = Degas Temperature $T_2$ = Compaction Temperature $T_3$ = Extrusion Temperature $E_R$ = Extrusion Ratio, which is the ratio of the cross sectional area of the extruded billet to the cross sectional of the extruded rod.

$\dot{\epsilon}$ = Strain Rate ($sec^{-1}$)

t = Time at highest degassing temperature (hours)

and all temperatures are in degrees Rankine. The use of the formula permits the selection of composition and consolidation conditions which mutually satisfy the strength requirement and the permissible extrusion conditions for a particular extrusion. By particular extrusion is meant the extrusion variables which are selected by cost considerations and/or equipment availability. The remaining variables can be controlled by use of the equation to obtain a desired strength level.

Using the method of this invention, dispersion-strengthened mechanically alloyed aluminum-magnesium with excellent corrosion resistance can be processed to products having an ultimate room temperature tensile strength of at least about 90 ksi and up to over 120 ksi and even higher.

DESCRIPTION OF PREFERRED EMBODIMENTS

As indicated above, FIGS. 1 and 2 disclose a pattern of behavior of materials of the present invention during thermomechanical conditions. While the invention is disclosed herein mainly with reference to dispersion-strengthened mechanically alloyed aluminum containing, by weight, about 4 to 5% magnesium, about 0.2 to $2\frac{1}{2}$% carbon, and about 0.3 to 4% oxygen, prepared under given conditions for extrusion, it will be understood that the patterns of behavior disclosed can be applied more generally. Thus, powders of various compositions and prior conditioning can be used and hot worked in a manner other than extrusion. As indicated above, as a practical matter there will be conditions fixed by commercial processing equipment available or on hand and by considerations of cost. However, on the basis of the unexpected behavior disclosed herein, fixed conditions can be taken into account and variables such as composition and treatment of powders, and consolidation conditions can be adjusted to optimize workability during processing and strength in the product for a particular end use, as explained in further detail below.

COMPOSITION

The dispersion-strengthened mechanically alloyed aluminum of the present invention is composed principally of aluminum and dispersoid. It may also contain various additives which may, for example, solid solution harden or age harden the aluminum and provide certain specific properties. Magnesium, for example, which forms solid solutions with aluminum will provide additional strength with corrosion resistance, good fatigue resistance and low density. Other additives for additional strength are, for example, Li, Cr, Si, Zn, Ni, Ti, Zr, Co, Cu and Mn. Additives to aluminum and the amounts added are well known in the art.

In general, the dispersion-strengthened mechanically alloyed aluminum of the present invention contains, by weight, at least about 80% and preferably at least about 90% aluminum, up to about $2\frac{1}{2}$% carbon and up to about 4% oxygen may be present.

In one embodiment of the invention, the composition may consist apart from the dispersoid, trace elements and impurities, of substantially only aluminum. As indicated above, the mechanical alloying process has the capability of producing high strength aluminum powder which contains a relatively low level of dispersoid. Substantially pure dispersion-strengthened mechanically alloyed aluminum has the qualities of improved strength, high electrical conductivity and good thermal stability. With increase in dispersoid level, the pure aluminum alloy has a further improvement in high temperature strength with some sacrifice in electrical conductivity.

The dispersoid may be, e.g., an oxide, carbon, silicon, a carbide, a silicide, aluminide, an insoluble metal or intermetallic which is stable in the aluminum matrix at the ultimate temperature of service. Examples of dispersoids are alumina, magnesia, thoria, yttria, rare earth metal oxides, aluminum carbide graphite, iron aluminide. The dispersoid such as $Al_2O_3$, MgO, C may be added to the composition in dispersoid form, e.g., as a powder, or they may be formed in-situ. Preferably the dispersoid is formed in-situ during the production of the mechanically alloyed powder. The dispersoids may be present in the range of a small but effective amount for increased strength up to about 5 volume % or even as high as $8\frac{1}{2}$ volume %. Preferably the dispersoid level is as low as possible consistent with desired strength.

In a preferred embodiment of the present invention, for high corrosion resistance, improved strength, good fatigue resistance and satisfactory workability, the dispersion-strengthened mechanically alloyed aluminum consists essentially, by weight, of a small but effective amount of magnesium for improved strength up to about 7% magnesium in aluminum, up to about $2\frac{1}{2}$% carbon and up to about 4% oxygen.

PREPARATION PRIOR TO THERMOMECHANICAL TREATMENT

Mechanical Alloying

Powder compositions treated in accordance with the present invention are all prepared by a mechanical alloying technique. This technique is a high energy milling process, which is described in the aforementioned patents incorporated herein by reference. Briefly, aluminum powder is prepared by subjecting a powder charge to dry, high energy milling in the presence of a grinding media, e.g. balls, and a weld-retarding amount of an asymmetric organic compound (i.e., a surfactive agent) under conditions sufficient to comminute the powder particles of the charge, and through a combination of comminution and welding actions caused repeatedly by the milling, to create new, dense composite particles containing fragments of the initial powder materials intimately associated and uniformly interdispersed. The surfactive agent is preferably a volatilizable organic material such as organic acids, alcohols, heptanes, aldehydes and ethers. The formation of dispersion-strengthened mechanically alloyed aluminum is given in detail in U.S. Pat. Nos. 3,740,210 and 3,816,080, mentioned above. Suitably the powder is prepared in an attritor using a ball-to-powder ratio of 15:1 to 60:1. Preferably the surfactive agents are methanol, stearic acid, and graphite. Carbon from these organic compounds is incorporated in the powder, and it contributes to the dispersoid content.

Degassing

Before the dispersion-strengthened mechanically alloyed powder is consolidated by a thermomechanical treatment, it must be degassed. A compaction step may or may not be used.

In the mechanical alloying processing step, various gases such as $H_2$ or $H_2O$, may be picked up by the powder particles, and if it is not removed before hot working, the material may blister. Degassing must be carried out at a high temperature, e.g., in the range of 700° to 1050° F. (370° to 565° C.). Degassing may be accomplished before compacting the powder, e.g. by placing the powder in a metal can and evacuating the can under vacuum at an elevated temperature. After degassing the can may be sealed and hot compacted against a blank die in an extrusion press. The can material may be subsequently removed by machining, leaving a fully dense billet for further working. Alternatively, the material may be degassed as a loose powder in a protective atmosphere at an elevated temperature. In another alternative method a billet compacted at room temperature to less than theoretical density, e.g. 85% theoretical density, may be annealed under argon to remove gasses. In any degassing process a time-temperature interrelationship is involved. Preferably, the time-temperature combination is chosen to minimize loss of strength in the powder and for reasons of cost it is preferred to work materials at the lowest temperature possible consistent with other factors. Preferably the argon degassing method lowers the time at elevated temperature, permitting higher strength to be achieved at lower dispersoid levels.

THERMOMECHANICAL TREATMENT

Figure 3:
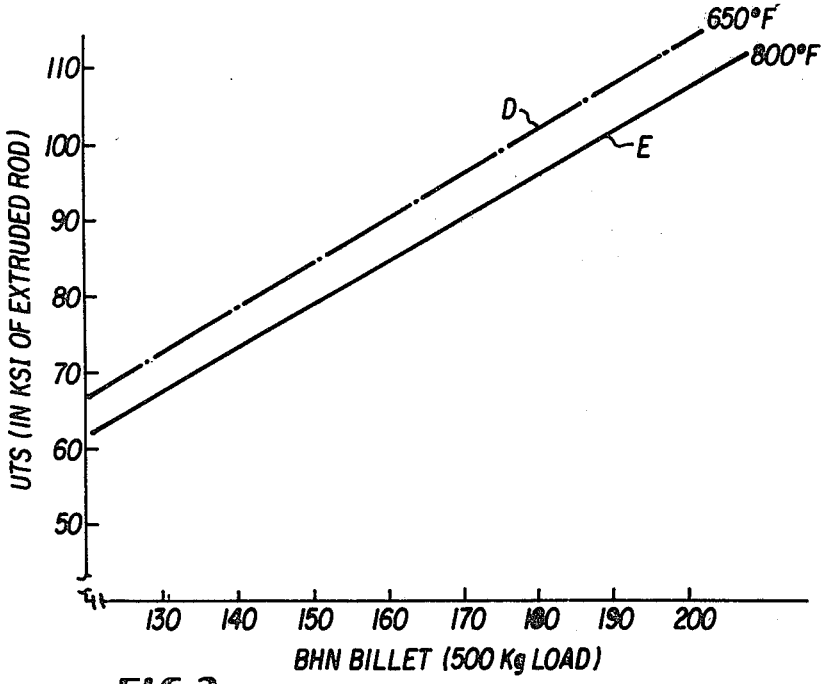
FIG. 3 is a graph showing the direct relationship between Brinell hardness (BHN) of compacted billets and room temperature tensile strength (UTS) of rods extruded from each given billet of a dispersion-strengthened mechanically alloyed aluminum of the present invention. The alloys have different dispersoid levels, varying from about 1.5 to 4.5 vol. %, and varying strength, but are all extruded at an extrusion ratio of 33.6:1 at either 650° F. (Curve D) or 800° F. (Curve E).

As indicated above, certain processing conditions such as extrusion ratio will be, or are more likely to be fixed, e.g. by the equipment on hand. Variable conditions are more likely to be temperature and extrusion rate. As indicated above, dispersoid content may be varied. Generally speaking, to process the material in accordance with the present invention, one would proceed as follows: (1) determine which processing variables are fixed by outside factors. (Assume, for example, the extrusion ratio is fixed at 30:1 and strain rate is no greater than 1 inch per second.), (2) select a dispersoid content which has the potential to meet strength/ductility requirements and use additives if indicated, for specific properties, (3) select a degas temperature to provide a margin of safety over the highest temperature the material will see during thermomechanical processing or service, (4) select a compaction temperature. (For convenience, the compaction temperature is often the same as the degassing temperature to enable compaction to be done immediately after degassing is complete, thereby eliminating an additional powder heat-up.) and (5) the strength of the finished product can be estimated from a Brinell hardness indentation made on the compacted can which correlates linearly to the ultimate tensile strength (UTS), of the finished product (extruded rod) as shown in FIG. 3. The desired strength-workability combination can be obtained by selecting the extrusion temperature according to a working temperature-strength pattern such as shown in FIG. 1. It is important to note that the invention offers other degrees of freedom, for example, alterations in degassing time or extrusion speed can also be used to tune properties to the desired level.

The following examples illustrate processing variations on dispersion-strengthened mechanically alloyed aluminum compositions in accordance with the present invention. Samples of dispersion-strengthened mechanically alloyed aluminum were prepared by high energy milling in a 4S, 30S or 100S Szegvari attritor for 6 to 16 hours at a ball-to-powder ratio of about 20:1 or 24:1 by weight in a nitrogen or air atmosphere, in the presence of either methanol or stearic acid as the surfactive agent. The samples prepared had the nominal compositions and were made under the processing conditions shown in Table I. Compositions given above and in the examples are in weight percent except for dispersoid level which are given in volume percent.

TABLE I

| Powder Sample | Composition (Wt. %) Mg | C | O | Al | (v %) Dispersoid |
|---|---|---|---|---|---|
| A | 4 | .54 | 1.5 | Bal. | 2.6 |
| B | 5 | .27 | 1.2 | Bal. | 2.4 |
| C | 4 | .55 | 1.79 | Bal. | 2.98 |
| D | 4 | 1.25 | .89 | Bal. | 2.80 |

EXAMPLE 1

This example illustrates the effect degassing temperature has on room temperature strength and ductility of extruded rod. Two cans of powder Sample A were compacted and degassed, one at 950° F. (510° C.) and the other at 800° F. (427° C.) for a time of 3 hours each. Both cans were extruded to ⅝" diameter rod at 800° F. at an extrusion ratio (E/R) of 33.6:1. Two cans of powder Sample B were degassed for 3 hours, one at 1050° F. (566° C.) and the other at 950° F. (510° C.). After degassing the second two samples were rolled to 0.80" diameter rod at 800° F. Room temperature tensile and ductility tests were performed on the resultant rods. Results are shown in TABLE II.

TABLE II

| Test No. | Powder Sample | Degas T (°F.) | Compaction T (°F.) | YS ksi | UTS ksi | El. % | R.A. % |
|---|---|---|---|---|---|---|---|
| 1 | A | 950 | 950 | 75.6 | 82.4 | 7 | 29.5 |
| 2 | A | 800 | 800 | 80.8 | 87.9 | 6 | 25 |
| 3 | B | 1050 | 800 | 66.3 | 69.7 | 8 | 29 |
| 4 | B | 950 | 800 | 74.2 | 77.3 | 6 | 3 |

The data show that for each type of material an increase in degassing temperature decreases strength.

EXAMPLE 2

This example illustrates the effect of temperature of thermomechanical treatment on strength of dispersion-strengthened mechanically alloyed aluminum samples having the nominal composition and the powder processing conditions of powder Sample B.

Six identical cans of powder type B were canned and degassed for 3 hours at 950° F. (510° C.). Each can was compacted and extruded at temperature $T_i$, where $T_i$ took the values 950°, 850°, 800°, 750°, 650°, 550° F. The extrusion ratio was held constant at 13.6. Tensile specimens were taken from the middle of each extruded rod to determine the effect of extrusion temperature on tensile properties. The results are given in FIG. 1.

FIG. 1 shows the unexpected effect of extrusion temperature on the room temperature ultimate tensile strength (UTS) of a dispersion-strengthened mechanically alloyed aluminum. The pattern of behavior includes a strength-temperature plateau "P", which illustrates that an increase in working temperature up to a maximum temperature which is roughly 750° F. (400° C.) has substantially no affect on strength. The sharp transition to lower strength relative to the working temperature referred to above as the critical working temperature-strength zone, "TZ", occurs in the region between about 750° and 800° F. (400° C. and 425° C.). In subsequent tests on comparable materials a mean increase of 5.8 ksi in tensile strength occurred in lowering the extrusion temperature from 800° F. to 650° F. (425° C. to 340° C.) on 14 experimental samples. An increase in strength for at least one sample was found to be as high as 20 ksi.

EXAMPLE 3

This example illustrates the effect of extrusion ratio on strength of dispersion-strengthened mechanically alloyed aluminum samples of this invention, and it shows a comparision with prior art materials.

Six cans of powder type C were degassed for 3 hours at 950° F. (510° C.). Five cans were extruded at 650° F. (340° F.) at a ratio of 13.1, 23.4, 33.6, 52.6, and 93.4, respectively. The sixth can remained as compacted, which corresponds to an extrusion ratio of 1. It is noted that the cans were extruded at a temperature well into the higher strength region to avoid excursions into the transition region (i.e., the critical working temperature-strength transition zone) by a slight temperature fluctuation. Longitudinal tensile properties were determined and the data plotted as Curve A of FIG. 2.

Unexpectedly the tensile strength decreases with increasing the extrusion ratio for extrusion ratios up to about 50. This is contrary to behavior encountered with conventional alloys. Curves B and C of FIG. 2, for example, which are based on the aforementioned study by Swartzwelder in the INT. J. POWDER MET., show that strength increases initially with extrusion ratio. The reference gives the dispersoid levels as 8% and 14%, but it is ambiguous on whether this is volume or weight %. It is believed to be weight %. In any event both alloys have a higher volume percent dispersoid than the present alloy of Curve A having a dispersoid level of about 2.4 vol. %; which shows a marked difference in strength.

FIGS. 1 and 2 illustrate the unexpected strength-workability interrelationship of alloys of this invention, the understanding of which constitutes a useful means of controlling the properties of dispersion-strengthened mechanically alloyed aluminum.

EXAMPLES 4

This example illustrates the use of the formula given above to select the composition and consolidation conditions which mutually satisfy the strength requirement and permissible extrusion conditions for a particular extrusion.

Seventy-eight samples of dispersion-strengthened mechanically alloyed aluminum 4–5 wt. % magnesium samples were prepared essentially comparable to powder samples A, B and C, but containing various amounts of oxygen and carbon. Compaction and degassing temperatures varied from about 550° to 1050° F. (285° to 565° C.), extrusion temperatures varied from 550° to 950° F. and extrusion ratios from 13:1:1, to 93.4:1. The compositions contained, in addition to aluminum and magnesium, about 0.8 to 2.0 wt. % oxygen, and 0.2 to 1.9 wt. % carbon. (About 1 wt. % O corresponds to about 1.25 vol. % oxide dispersoid and about 1 wt. % C corresponds to about 1.35 vol. % carbon dispersoid.) It was found that the actual room temperature tensile strength varied from theoretical calculated from the equation given above by +6.2 vs. −7.3 ksi.

EXAMPLE 5

The following example shows how the knowledge of the effect of degassing time on tensile properties can be used to control properties of the final product.

Two billets or powder type D were formed in the following degassing sequences:

Billet 1: Degas for 3 hours at 950° F. in can and compact at 950° F. (510° C.).

Billet 2: Degas for 1 hour at 950° F. in open tray under argon atmosphere, can, degas for 1½ hours at 450° F. compact at 450° F. (230° C.).

The two billets were extruded to rod at a ratio of 33.6:1 at 650° F. (340° C.). Data obtained on tensile strength and ductility of the samples are given in TABLE III.

TABLE III

| Billet No. | Hrs. at Highest Degassing T | UTS (ksi) | YS (ksi) | % El. | % R.A. |
|---|---|---|---|---|---|
| 1 | 3 | 93.3 | 85.5 | 3 | 2.8/15.6* |
| 2 | 1 | 111.9 | 108.3 | <1 | <1 |

It can be seen from the data in TABLE III that the shorter time at the higher degassing temperature (Billet 2) is responsible for a substantial increase in tensile strength, viz. over 18 ksi, of the finished product.

EXAMPLE 6

This example illustrates the use of processing information in accordance with the present invention.

Part A

To produce high strength corrosion resistant parts, an alloy of choice is a dispersion-strengthened mechanically alloyed aluminum containing about 4–5 wt. % magnesium, using 1.75 wt. % stearic acid, and a powder of type D is preferred.

Part B

The powder of Part A is to be used for lightweight watches which are to be machined out of aluminum.

To insure complete degassing, a 3 hour 950° F. vacuum degas is used followed by 950° F. compaction. Because the pieces are to be machined and service conditions warrant extremely high strength, the finished product is the compacted billet. Mechanical properties of the compacted material are:

| UTS (ksi) | YS (ksi) | % El. | % R.A. |
|---|---|---|---|
| 122.2 | 111.3 | 2 | 4 |

Part C

The powder of Part A (type D powder) is to be used for high strength aircraft extrusions with properties including greater than 90 ksi room temperature tensile strength and a minimum of 3% elongation so as to permit stretch straightening after extrusion. Using the information of FIGS. 1 and 2, the powders are processed as follows.

The powder is degassed at 950° F. to insure that all detectable hydrogen is removed and degassing is continued for 4 hours. The additional hour (compared to degassing duration of Part B) causes sufficient softening to occur so that extrusions of a 33.6:1 ratio will not have a great overshoot in strength. The hardness of the compacted billet (176 BHN 500 kg load) indicates that strength will be greater than 90 ksi if extruded at 650° F. at a ratio of 33.6:1. The extrusion is carried out at 650° F. and properties are as follows:

| UTS (ksi) | YS (ksi) | % El. | % R.A. |
|---|---|---|---|
| 92.7 | 86.4 | 4 | 12.6 |

The results in Parts B and C demonstrate that the processing information of the present invention can be used to obtain the proper conditions for each specific application by utilization of the strength-workability trade-off associated with metal processing of dispersion-strengthened mechanically alloyed aluminum.

EXAMPLE 7

This example illustrates the increased workability with increased working temperature of aluminum alloys of the present invention.

Several heats of dispersion-strengthened mechanically alloyed aluminum powder containing about 4% magnesium were prepared. The powder was degassed at 950° F. for 3 hours, compacted at 950° F. and extruded at an extrusion ratio of 33.6:1. Extrusion temperature (E/T) for each heat was in sets, one at 650° F. and one at 800° F. Breakthrough pressure in ksi for extrusion at each temperature for typical samples are shown in TABLE IV.

TABLE IV

| Heat No. | Breakthrough Pressure (ksi) 650° F. | 800° F. |
|---|---|---|
| 1 | 3.45 | 2.25 |
| 2 | 3.05 | 2.3 |
| 3 | 3.75 | 2.35 |
| 4 | 3.20 | 2.05 |
| 5 | 3.40 | 2.90 |
| 6 | 2.98 | 2.15 |
| 7 | 3.35 | 1.93 |

The data in TABLE IV show that the breakthrough pressure is lower at higher temperature; or easier workability at higher temperature. Further experiments showed that breakthrough pressure is greater with increased extrusion ratio. FIG. 2 shows that strength is greater at lower extrusion ratios. Thus, at lower extrusion ratios workability is easier and higher strength material can be obtained.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. In a process for treating a dispersion-strengthened mechanically alloyed aluminum consisting essentially, by weight, of a small but effective amount for increased strength up to about 7% magnesium, up to about 2½% carbon, up to about 4% oxygen, and the balance essentially aluminum and said dispersoid content being a small but effective amount of dispersoid for improved strength up to about 8½ volume %, comprising working said aluminum at an elevated temperature to form a hot worked product having a required strength, the improvement comprising:

(a) selecting as the initial charge material a dispersion-strengthened mechanically alloyed aluminum material having in compacted form prior to working, a room temperature strength at least equal to the room temperature strength of the hot worked product, said charge material having the property in a temperature range up to incipient melting of increased workability with increasing working temperature;

(b) determining the working temperature-strength profile of the selected charge material, said profile being charterized by an overall decrease in strength relative to the working temperature; and (c) working the charge material at a temperature selected with reference to the working temperature-strength profile to optimize the workability of the charge material and the strength of the hot worked product.

2. A process according to claim 1, wherein the working temperature-strength profile includes a critical working temperature-strength transition zone which is characterized by a sharp lowering of room temperature strength relative to increased working temperature.

3. A process according to claim 2, wherein the said critical transition zone is preceded by a plateau region in which the strength of the product is substantially unaffected by increased temperature.

4. A process according to claim 3, wherein working of the charge material is carried out at a temperature selected in the plateau region for maximum strength.

5. A process according to claim 3, wherein working of the charge material is carried out at a temperature selected above the maximum temperature of the plateau region to achieve optimum workability of the charge material with sacrifice in strength of the hot worked product.

6. A process according to claim 1, wherein the working step comprises extruding the charge material.

7. A process according to claim 6, wherein for maximum strength the extrusion is carried out at a minimum ratio.

8. A process according to claim 1, wherein the dispersion-strengthened mechanically alloyed aluminum contains at least about 80 wt. % aluminum.

9. A process according to claim 1, wherein the dispersion-strengthened mechanically alloyed aluminum contains at least about 90 wt. % aluminum.

10. A process according to claim 1, wherein the dispersion-strengthened mechanically alloyed aluminum consists essentially of a small but effective amount of dispersoid for improved strength up to about 8½ volume % dispersoid, and the balance substantially aluminum.

11. A process for treating a dispersion-strenghthened mechanically alloyed aluminum consisting essentially, by weight, of a small but effective amount for increased strength up to about 7% magnesium, up to about 2½% carbon, about 0.3% up to about 4% oxygen, and the balance essentially aluminum, the improvement comprising working said aluminum at an elevated temperature to form a worked product of required strength, wherein said aluminum is characterized by increased workability as temperature increases within a temperature range up to incipient melting of said aluminum, and wherein said aluminum is characterized by a working temperature-strength profile for extrusion equivalent to the pattern of FIG. 1 and an extrusion ratio strength pattern equivalent to FIG. 2 Curve A, which comprises:

(a) selecting as the initial charge material a dispersion-strengthened mechanically alloy aluminum having in compacted form prior to working a room temperature tensile strength at least equal to the room temperature strength of the how worked product; and (b) extruding the charge material at a temperature selected with reference to the working-strength profile equivalent to the pattern shown in FIG. 1 to optimize the workability of the charge material and strength of the worked product.

12. A process according to claim 11, wherein the charge material consists essentially of about 2% up to about 5% Mg, up to about 2½% C, up to about 4% O, and the extrusion is carried out at a temperature below the critical working temperature-strength transition zone to obtain optimum strength in the hot worked product.

13. A process according to claim 12, wherein the extrusion is carried out at a temperature up to about 750° F.

14. A process according to claim 13, wherein the extrusion is carried out at an extrusion ratio of about 1.

15. A process for treating a dispersion-strengthened mechanically alloyed aluminum containing, by weight, from about 2% up to about 7% Mg, up to about 2½% C, and from up to about 4% O, by a method including steps comprising hot working said aluminum to form a consolidated product, the improvement of optimizing the strength of the consolidated product and workability during hot working by employing processing conditions in the interrelationship set forth by the following formula:

$$UTS = -0.059T_1 - 0.014T_2 - 0.034T_3 - 0.055E_R + 11.6\ (\text{wt. \% O}) + 20.1\ (\text{wt. \% C}) - 0.18\epsilon - 3t + 214.6$$

where

UTS = Ultimate Tensile Strength in ksi (at room temperature)

$T_1$ = Degas Temperature $T_2$ = Compaction Temperature $T_3$ = Extrusion Temperature $E_R$ = Extrusion Ratio, which is the ratio of the cross sectional area of the extruded billet to the cross sectional of the extruded rod.

$\dot{\epsilon}$ = Strain Rate ($sec^{-1}$)

t = Time at highest degassing temperature (hours)

16. A dispersion-strengthened mechanically alloyed aluminum of high corrosion resistance, having a composition consisting essentially, by weight, of magnesium in a small but effective amount for increased strength up to about 5% up to about 2½% carbon, up to about 4% oxygen, and the balance essentially aluminum and characterized by tensile strength at room temperature of at least about 90 ksi.

17. A dispersion-strengthened mechanically alloyed aluminum according to claim 16, wherein the magnesium content is about 2 to about 4%, the carbon level is at least about 0.2% and the oxygen level is at least about 0.3%.

18. A dispersion-strengthened mechanically alloyed aluminum prepared by the process of claim 1.

19. A dispersion-strengthened mechanically alloyed aluminum of high corrosion resistance having a composition consisting essentially, by weight, of magnesium in a small but effective amount for increased strength up to about 7%, up to about 2½% carbon, about 0.3% up to about 4% oxygen, and the balance essentially aluminum and characterized by a tensile strength at room temperature of at least about 66.3 ksi.

20. A dispersion-strengthened mechanically alloyed aluminum of high corrosion resistance having a composition consisting essentially, by weight, of magnesium in a small but effective amount for increased strength up to about 7%, up to about 2½% carbon, about 0.3% up to about 4% oxygen, and the balance essentially aluminum and characterized by a tensile strength at room temperature of at least about 66.3 up to about 122.2 ksi and an elongation up to about 8%.

21. As an article of manufacture a dispersion-strengthened mechanically alloyed aluminum-magnesium alloy according to claim 16 in the form of a shaped article.

22. As an article of manufacture a dispersion-strengthened mechanically alloyed aluminum-magnesium alloy according to claim 20 in the form of a shaped article.

* * * * *